United States Patent [19]

Steiner

[11] Patent Number: 4,655,259

[45] Date of Patent: Apr. 7, 1987

[54] LAMELLA FOR A PICKING COMB OF A WEAVING ROTOR

[75] Inventor: Alois Steiner, Rieden, Switzerland

[73] Assignee: Sulzer Brothers Limited, Winterthur, Switzerland

[21] Appl. No.: 843,075

[22] Filed: Mar. 24, 1986

[30] Foreign Application Priority Data

Apr. 2, 1985 [EP] European Pat. Off. ..... 85103966.9

[51] Int. Cl.[4] ..... D03D 47/30

[52] U.S. Cl. ..... 139/11; 139/435; 139/188 R

[58] Field of Search ..... 139/11 R, 11 A, 28, 139/188 R, 192, 429, 435

[56] References Cited

U.S. PATENT DOCUMENTS

| | | | |
|---|---|---|---|
| 3,848,642 | 11/1974 | Steiner | 139/28 |
| 4,492,255 | 1/1985 | Steiner | 139/28 |
| 4,512,374 | 4/1985 | Steiner | 139/28 |
| 4,531,555 | 7/1985 | Tatematsu et al. | 139/429 |
| 4,886,541 | 5/1986 | Steiner | 139/28 |

*Primary Examiner*—Henry S. Jaudon

*Attorney, Agent, or Firm*—Kenyon & Kenyon

[57] ABSTRACT

The weaving rotor for a series shed weaving machine is formed with picking combs which have lamellae of unitary structure to define a weft-guiding part and a warp-guiding part. The lamellae may be made of ceramic pressings with the two projections on the warp-guiding part being spaced apart to provide a relatively large entry zone for the insertion of the warp yarn.

16 Claims, 4 Drawing Figures

LAMELLA FOR A PICKING COMB OF A WEAVING ROTOR

This invention relates to a lamella for a picking comb for a weaving rotor. More particularly, this invention relates to a picking comb for use on a weaving rotor of a weaving machine.

As is known, weaving machines of the series shed type employ a weaving rotor on which a number of picking combs in the form of lamellae are mounted for the picking of weft yarns into a shed formed by warp yarns. In this regard, the lamellae have been formed with a weft guiding part having a picking aperture through which a weft yarn can be picked as well as a warp guiding part over which warp yarns may be guided and supported during the picking operation. In some cases, for example, as described in European Patent Application No. 83112062.1, the picking combs have lamellae which are in the form of flat or sheet lamellae so shaped that adjacent lamella cooperate in pairs to form an annular jet and a surface for supporting the warp yarns in a top shed position. In addition, the lamellae are arranged in groups with one lamella between any two groups having an annular jet connected to a source of compressed air so that the lamella is operative as a relay jet. However, one disadvantage of such a picking comb is that the lamella are multi-element components. As a result, the lamellae and the picking combs are relatively complicated and expensive to produce.

Accordingly, it is an object of the invention to provide a lamella of relatively simple and inexpensive constructure for a weaving rotor.

It is another object of the invention to reduce the cost of fabricating a weaving rotor for a series shed type weaving machine.

It is another object of the invention to provide a lamella which can be constructed at a relatively minimum cost.

Briefly, the invention provides a lamella for a picking comb of a weaving rotor which has a unitary structure defining a weft-guiding part including a picking aperture for passage of a picked weft yarn therethrough and a warp-guiding part including a pair of projections extending from a surface to define a passage therebetween for a warp yarn with a surface being disposed to support a warp yarn thereon during picking of the weft yarn, that is with the lamella in a top shed position.

The invention also provides a picking comb which is comprised of a plurality of lamellae which are mounted longitudinally of and in an elongated holder with at least some of the lamellae having a unitary structure as above. These lamellae may be disposed in groups within the holder of the picking comb with each two adjacent groups being separated by a lamella of narrowed cross section which defines a recess to receive a relay jet. In this case, the relay jet has an air outlet orifice directed in the picking direction into a weft tunnel defined by the picking apertures of the groups of lamellae.

Each lamella may be made of a one-piece pressing, for example a ceramic pressing. Alternatively, the lamella may have a hard smooth layer, for example made of ceramic, disposed on the warp guiding part. In addition, the warp-guiding projections may be disposed with the projection on the leading side at a higher elevation than the projection on the trailing side of the lamella in order to provide a substantial entry zone for a warp yarn between the two projections.

These and other objects and advantages of the invention will become more apparent from the following detailed description taken in conjunction with the accompanying drawings wherein.

Figure 1:
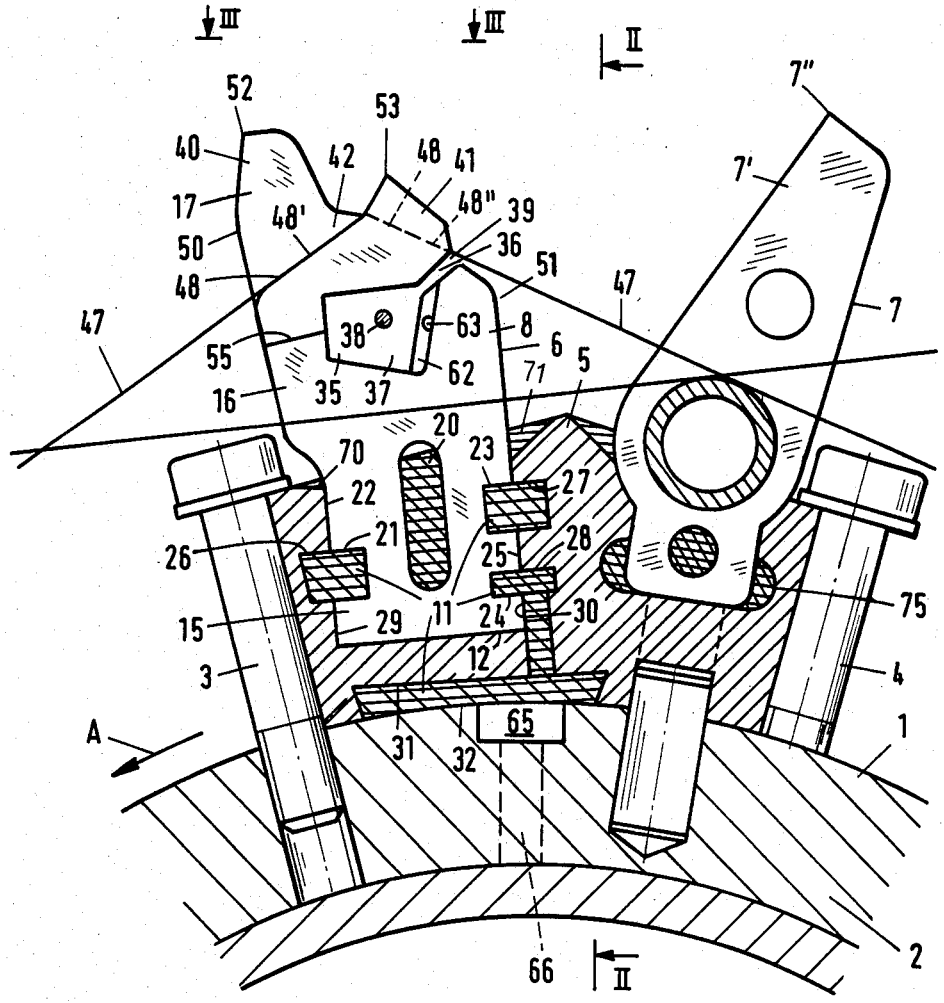
FIG. 1 illustrates a cross sectional view of a weaving rotor employing a lamella in accordance with the invention.

Referring to FIG. 1, a weaving rotor 2 for a series type weaving machine has a circular circumferential periphery 1 on which a plurality of holders 5 (only one of which is shown) are secured, for example, by means of screws 3, 4. The holders 5 are mounted on and across the rotor 2 while being distributed uniformly around the periphery 1.

Figure 2:
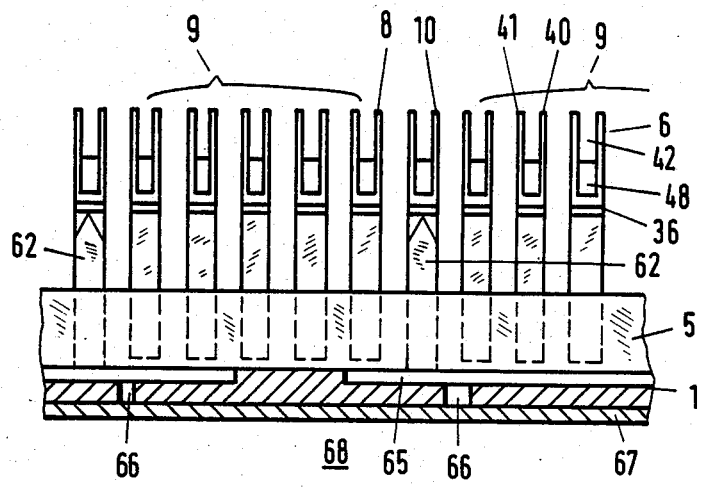
FIG. 2 illustrates a view taken on line II—II of FIG. 1.
Figure 4:
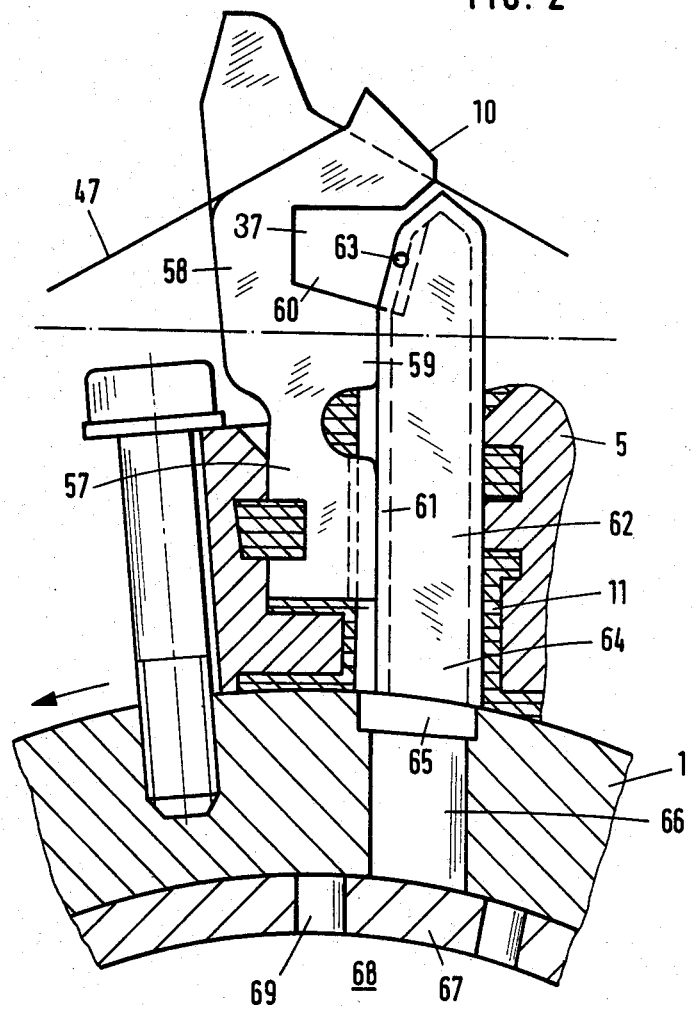
FIG. 4 illustrates a partial cross sectional view of a relay blowing position in accordance with the invention.

Referring to FIGS. 1 and 2, each holder 5 mounts a picking comb 6 and a beating-up comb 7. The picking comb 6 is formed of a plurality of lamellae 8 which are arranged in groups 9, for example of five lamellae, with an individual lamella 10, as shown in FIG. 4, disposed between each respective pair of groups 9. The lamellae 8,10 are secured by means of castable silicone rubber 11 within a groove 12 of the holder 5.

Each lamella 8, 10 is a unitary structure formed of a one-piece ceramic pressing. In this regard, each lamella 8, 10 has the advantage of being simple to produce and of providing a very hard and smooth support surface for the warp yarns so that the warp yarns cause very little wear and the working life of the lamella become very substantial.

Each lamella 8 has a mounting part 15, a weft-guiding part 16 and a warp-guiding part 17.

The mounting part 15 is formed with a longitudinal slot 20, a lateral recess 21 in an upstream side 22 and a pair of lateral recesses 23, 24 in an opposite trailing side 25. The holder 5 is provided with recesses 26, 27, 28 in the side walls 29, 30 of the groove 12 opposite to the lateral receses 21, 23, 24. In addition, a groove 31 is formed in the base 32 of the holder 5. As indicated in FIG. 1, all of the grooves and recesses are filled with the castable silicone rubber 11.

The weft-guiding part 16 of each lamella 8 is formed with a picking aperture 35 for passage of a picked weft yarn 38 therethrough as well as a weft exit aperture 36 which communicates with the picking aperture 35. The picking apertures 35 of all the lamellae 8, 10 cooperate to form a tunnel 37 for the weft yarn 38 while the apertures 36 cooperate to form a weft yarn exit 39.

The warp-guiding part 17 of each lamella 8 includes a pair of projections 40, 41 which extend from a surface 48 in order to define a passage 42 (see FIG. 2) for a warp yarn 47. As indicated, the projections 40, 41 are peripherally displaced relative to each other. The surface 48 forms the base of the passage 42 and is disposed to support the warp yarn 47 thereon with the lamella 8 in a top shed position during picking of the weft yarn 47. As indicated in FIG. 1, the support surface 48 has an arrival surface 48′ and a departure surface 48″ for the warp yarn 47.

Figure 3:
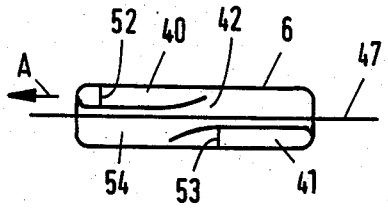
FIG. 3 illustrates a view taken on line III—III of FIG. 1.

When the rotor 2 rotates in the direction indicated by the arrow A in FIG. 1, the projection 40 is on the leading side 50 of a lamella 8 and the projection 41 is on the trailing side 51 of the lamella 8. As considered radially, the position 52 at which the leading projection 40 dips into the warp is higher than a position 53 at which the trailing projection 41 dips into the warp. The maximum radial height of the position 52 is determined by the radially highest position 7″ of the beating-up lamella 7′ of the beating-up comb 7 and must be lower than the position 7″. The two positions 52, 53 are separated from one another in the peripheral direction as indicated in FIG. 3 such that a substantial entry zone 54 is left between the projections 40, 41, thus ensuring satisfactory control of the warps by the warp control (not shown).

The lamellae 8, 10 may be made of some other material than being entirely made of ceramic. For example, the lamellae may be made of a light weight metal and may have a hard smooth layer or coating of ceramic or some other hard smooth material on at least the warp-guiding part 17.

Each lamellae 8, 10 may also have a separate warp-guiding part which may be a pressing or a coated element. A boundary line 55 in FIG. 1 between the warp-guiding part and the weft guiding part 16 indicates this kind of division of a lamella. The two parts can be interconnected, for example by gluing or by a push type connection.

A plurality of lamellae can be connected together to form a unit, for example by simultaneous pressing of a pressing composition. For example, the lamellae of a group 9 as shown in FIG. 2 can be combined to form a unit of this kind.

Referring to FIG. 4, the lamella 10 between the groups 9 of lamellae 8 are of similar construction except for having a mounting part 57 and a weft-guiding part 58 on the trailing side 59 below the picking aperture being narrower. As indicated, this lamella 10 forms a picking aperture 60 of smaller dimension but which registers with the weft tunnel 17 formed by the lamellae 8. In addition, the space defined by the narrower parts of the lamella 10 receive a relay jet 62 having an air outlet aperture 63 which is directed into the weft tunnel 17 and into the picking direction. As indicated, the relay jet 62 has a bottom end 64 which is disposed in a longitudinal channel 65 in the periphery 1 of the rotor. Of note, one or more jets may extend into the longitudinal channel 65.

Each channel 65 in the rotor communicates by way of a bore 66 with an actuating tube 67 within the rotor 2. In addition, the tube 67 has an interior 68 which communicates with a source of compressed air. Depending upon the angular position of the tube 67 relative to the rotor, one or more relay jets communicate by way of bores 69 in the tube 67 with the source of compressed air.

Referring to FIG. 1, the holder 5 have bevellings 70, 71 respectively, on the side of the flanks of the lamellae 8, 10 which are operative to facilitate injection of the castable silicone 11. The advantage of using silicone is that it can be readily cut locally after curing so that any damaged lamellae may be removed. The replacement lamella can be secured simply and rapidly by a further injection of the castable silicone.

The beating-up comb 7 is disposed in a suitable groove 75 in the holder 5. However, the beating-up comb 7 may also be received in a separate holder.

Because of the very satisfactory properties of the lamellae 8 with respect to the insertion of the warp yarns, the lamellae 8 can be narrower than previously known lamellae. Consequently, more space is available in the peripheral direction of the rotor so that the screws 3, 4 for securing the holder 5 can be disposed on the periphery of the rotor 2. Previously, such screws had to be disposed, for reasons of space, on the inner periphery of the rotor so that the rotor had to be constructed in two parts.

The invention thus provides a lamella which can be manufactured in a relatively simple and economical manner.

Further, the invention provides a picking comb wherein the individual lamella provide a hard surface as well as a positively defined space for the guiding of a warp yarn in a top shed position while at the same time providing a weft tunnel for a weft yarn into which an air jet can be reliably expelled.

Still further, the invention provides a picking comb in which air relay jets can be readily incorporated without the need to occupy excess space.

The invention also permits the mounting of a plurality of holders for picking combs on a one piece rotor.

What is claimed is:

1. A lamella for a picking comb of a weaving rotor, said lamella having a unitary structure defining
   - a weft-guiding part including a picking aperture for passage of a picked weft yarn therethrough; and
   - a warp-guiding part including a pair of projections extending from a surface to define a passage therebetween for a warp yarn with said surface being disposed to support a warp yarn thereon with the lamella in a top shed position, said projections being peripherally displaced relative to each other with one of said projections being on a leading side of said warp-guiding part and the other of said projections being on a trailing side of said warp-guiding part.

2. A lamella as set forth in claim 1 made of a one-piece pressing.

3. A lamella as set forth in claim 2 wherein said pressing is a ceramic pressing.

4. A lamella as set forth in claim 1 which further includes a hard smooth layer on said warp-guiding part.

5. A lamella as set forth in claim 4 wherein said layer is a ceramic layer.

6. A lamella as set forth in claim 1 wherein said one projection is at a higher elevation than said other projection relative to said surface.

7. A lamella as set forth in claim 1 wherein said weft-guiding part and said warp-guiding part are secured together.

8. A lamella for a picking comb of a weaving rotor, said lamella having a one-piece ceramic pressing defining
   - a weft-guiding part including a picking aperture for passage of a picked weft yarn therethrough; and
   - a warp-guiding part including a pair of projections extending from a surface to define a passage therebetween for a warp yarn with said surface being disposed to support a warp yarn thereon with the lamella in a top shed position.

9. In combination
   - an elongated holder; and
   - a plurality of lamalae mounted longitudnally of and in said holder to define a picking comb, at least one of said lamellae having a unitary structure defining a weft-guiding part including a picking aperture for passage of a weft yarn therethrough and a warp-guiding part including a pair of projections extending from a surface to define a passage therebetween for a warp yarn with said surface being disposed to support a warp yarn thereon during picking of the weft yarn, said projections being peripherally displaced relative to each other with one of said projections being on a leading side of said warp-guiding part and the other of said projections being on a trailing side of said warp-guiding part.

10. A picking comb as set forth in claim 9 wherein said lamellae are disposed in spaced apart groups with said picking apertures thereof defining a weft tunnel and which further includes a relay jet between each respective pair of said groups of lamellae having an air outlet orifice directed into said weft tunnel.

11. In combination a weaving rotor;

at least one holder mounted on and across said rotor;

a plurality of lamellae mounted in and longitudinally of said holder, at least some of said lamellae having a unitary structure defining a weft-guiding part including a picking aperture for passage of a weft yarn therethrough and a warp-guiding part including a pair of projections extending from a surface to define a passage therebetween for a warp yarn with said surface being disposed to support a warp yarn thereon during picking of the weft yarn, said projections being peripherally displaced relative to each other with one of said projections being on a leading side of said warp-guiding part and the other of said projections being on a trailing side of said warp-guiding part.

12. The combination as set forth in claim 11 wherein said lamellae are disposed in spaced apart groups with said picking apertures thereof defining a weft tunnel and which further includes a relay jet between each respective pair of said groups of lamellae having an air outlet orifice directed into said weft tunnel.

13. The combination as set forth in claim 11 wherein one of said lamellae is disposed between each respective pair of said groups of lamellae with a reduced transverse width to define a space receiving said relay jet.

14. The combination as set forth in claim 11 wherein each group of lamellae is formed as a unit.

15. The combination as set forth in claim 11 which further comprises a beating-up comb mounted in said holder downstream of said picking comb.

16. The combination as set forth in claim 15 which further comprises a plurality of screws securing said holder to a periphery of said rotor.

* * * * *

UNITED STATES PATENT AND TRADEMARK OFFICE

CERTIFICATE OF CORRECTION

PATENT NO. : 4,655,259

DATED : April 7, 1987

INVENTOR(S) : Alois Steiner

It is certified that error appears in the above—identified patent and that said Letters Patent is hereby corrected as shown below:

Column 1, line 35 "structure" should be -struction-
Column 3, line 58 "have" should be -has-
Column 4, line 66 "lamalae" should be -lamellae-

Signed and Sealed this

Twentieth Day of October, 1987

*Attest:*

DONALD J. QUIGG

*Attesting Officer*

*Commissioner of Patents and Trademarks*